United States Patent [19]

Tyrer et al.

[11] 4,201,178

[45] May 6, 1980

[54] ENGINE FLAMEPROOFING

[75] Inventors: Philip G. Tyrer, Brighton; John Pluck, Henfield, both of England

[73] Assignee: Pyroban Limited, Horsham, England

[21] Appl. No.: 784,639

[22] Filed: Apr. 4, 1977

[30] Foreign Application Priority Data

Jun. 3, 1976 [GB] United Kingdom ..... 22986/76
Apr. 5, 1976 [GB] United Kingdom ..... 13777/76

[51] Int. Cl.[2] ..... F02B 77/08; A62C 35/02

[52] U.S. Cl. ..... 123/198 D; 123/142; 169/60

[58] Field of Search ..... 123/198 D, 198 DB, 142

[56] References Cited

U.S. PATENT DOCUMENTS

| | | | |
|---|---|---|---|
| 3,371,634 | 3/1968 | LaLande | 123/198 DB |
| 3,927,656 | 12/1975 | Reed et al. | 123/198 D |
| 3,983,859 | 10/1976 | Pritchard | 123/198 D X |

FOREIGN PATENT DOCUMENTS

| | | | |
|---|---|---|---|
| 587457 | 11/1959 | Canada | 123/198 DB |
| 1166556 | 3/1964 | Fed. Rep. of Germany | 123/198 D |
| 707421 | 12/1930 | France | 123/198 D |
| 888949 | 2/1962 | United Kingdom | 123/198 D |

*Primary Examiner*—Ira S. Lazarus
*Attorney, Agent, or Firm*—Cushman, Darby & Cushman

[57] ABSTRACT

Apparatus and a method are disclosed for flame-proofing an internal combustion engine by provision of a sensor for detecting the presence of flammable gases in the vicinity of the assembly, a canopy shrouding a hot surface of the engine, and a source of non-flammable fluid operable responsive to signals from the sensor to inject the fluid into the space between the canopy and the said surface, thereby cooling the hot surface and inerting the atmosphere within the canopy.

19 Claims, 4 Drawing Figures

ENGINE FLAMEPROOFING

The present invention relates to an internal combustion engine assembly, to a flame-proofing shroud attachment for an internal combustion engine, and to a method of flame-proofing an internal combustion engine.

An internal combustion engine used on an oil rig, in a mine, or in other places where flammable materials may be present can present a risk of ignition of the materials, of their vapours, as a result of contact thereof with a hot surface of the engine, for example a surface of the exhaust manifold or a turbo-charger. Certain vapours, e.g. some hydrocarbons, when mixed with air, can be ignited, possibly explosively, by hot surfaces at such temperatures, and in some circumstances precautions need be taken to prevent such an occurrence. A common surface temperature to which hot surfaces of, for example, diesel engines for use on oil rigs have been restricted for safety purposes is 200°-250° C. Cooling hot surfaces to this temperaure, e.g. by water-jacketing, is costly and frequently involves an unacceptable increase of bulk of the engine assembly.

According to one aspect of the present invention an internal combustion engine assembly comprises an engine, a sensor for detecting the presence of flammable gases in the vicinity of the assembly, a canopy shrouding a hot surface of the engine, and a source of non-flammable fluid operable responsive to signals from the sensor to inject the fluid into the space between the canopy and the said surface.

Thus no attempt is made to reduce the running temperature of the hot surface, as long as the engine is running in a normal environment, but as soon as a critical concentration of a dangerous gas or mixture of gases is detected, the hot surface will be cooled and the atmosphere around the hot surface rendered inert by the fluid.

The fluid may be an inert gas, e.g. carbon dioxide or, more preferably, a halogenated gas such as is available in the United Kingdom under the trade name "Halon."

Sufficient fluid must be injected both to reduce the hot surface temperature to an acceptable level and also to inert satisfactorily the said atmosphere.

The inert gas may be held in one or more pressurised containers which may be mounted on or near the canopy. The sensor may be connected to a valve at the head of the or each pressurized container through booster and servo means. The servo means may open the valve on receipt of a boosted signal from the sensor to inject the inert gas contained in the pressurised container, into space between the canopy and the associated hot surface of the engine. In another form the sensor control means may fire electrically a linear actuator such as that available in the United Kingdom from the Nobel Division of Imperial Chemical Industries as "Metron" actuators. These can be arranged to puncture a pressure seal at the head of the or each container to release the gas.

The fluid may be water and its source may then be an external supply or may be a part of the engine coolant system. When the latter is the case the coolant water, being hot itself, will impart a lesser heat shock to a hot surface of the engine than would colder water from an external supply. The water may be injected by pumping means actuated by the sensor, or under gravity through cocks or valves similarly actuated.

The water, in addition to cooling the hot surface of the engine will inert the atmosphere surrounding the hot surface.

The sensor may be disposed at the engine air inlet and may further operate an induction air shut-off valve on detection of a critical concentration of flammable gases to close off the engine air inlet.

There may also be further inert gas injection means, responsive to the sensor, disposed to inject inert gas, e.g. carbon dioxide or "Halon" into the engine downstream of the shut-off valve. The effect of operation of the shut-off valve and, if present, of the further inert gas injection means, is rapidly to stop the engine, which will, of course, result in further cooling thereof.

The further inert gas injection means may comprise a pressurised container of inert gas connected by conduits to the engine assembly. The release of the gas from the container may be used to operate the shut-off valve pneumatically by tripping a cam and latch mechanism holding open the shut-off valve against a spring. This may be achieved using a pneumatic cylinder having a piston rod which trips the said mechanism in its extended position. Movement of the piston in the cylinder may open a port so that the gas used to move the piston to be released through conduits into the engine.

It may be possible to use the same container as the source of fluid, e.g. "Halon" gas, to be injected into the said space and also into the engine, with appropriate arrangements to provide the different flow rates and concentrations required for the different jobs.

The canopy may be shaped to fit over the exhaust manifold of the engine. If the engine is fitted with a turbo-charger unit a further canopy may be provided for the turbo-charger unit, or a single canopy may fit over both the exhaust manifold and the turbocharger unit. Other surfaces of the engine likely to become hot may also be provided with their own canopy, or a single canopy may be provided for all the hot surfaces of the engine.

The canopy may be constructed not only to fit over the associated hot surface, but also in a form such that movement of the fluid within the said space is enhanced. By appropriate shaping of the canopy and positioning of the points at which the fluid is introduced into the space, it may be caused to flow, e.g. in vortices, over the hot surface to speed cooling thereof.

According to a further aspect of the invention a flameproofing shroud attachment for a hot surface of an internal combustion engine comprises a canopy for the said surface, and means to supply and inject non-flammable fluid into the atmosphere within the canopy.

According to a still further aspect of the invention a method of flameproofing an internal combustion engine having a hot surface comprises detecting the presence in the vicinity of the engine of flammable gases, and in the event of such detection, automatically actuating fluid injection means to inject non-inflammable fluid into a space between the said surface and a canopy disposed thereover.

The various aspects of the invention may be performed in many ways and some specific embodiments will now be described, by way of example, with reference to the accompanying, somewhat diagrammatic, drawings in which.

Figure 1:
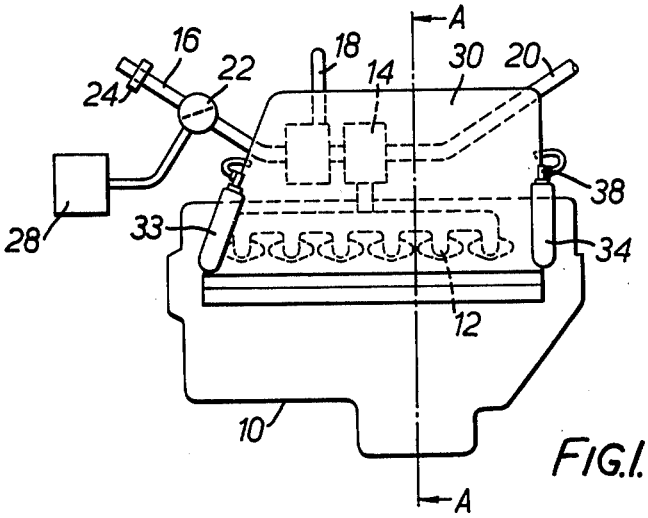
FIG. 1 is a side view of an internal combustion engine assembly embodying the invention.
Figure 2:
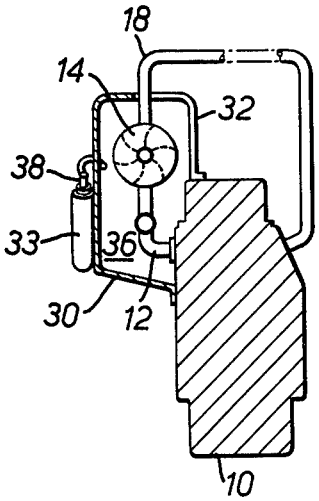
FIG. 2 is a partial section along line A—A of FIG. 1.

Referring to the drawings, FIGS. 1 and 2 show a diesel engine 10 having an exhaust manifold 12. The output from the exhaust manifold 12 is connected to a turbocharger unit 14 adapted to blow air from an inlet pipe 16 through ducting 18 into the inlet manifold of the engine 10. The exhaust from the turbo-charger unit 14 is expelled through ducting 20.

The inlet pipe 16 is provided with a shut-off valve 22 and an in-line sensor 24. The sensor 24 is adapted to detect the presence of flammable vapour in the air and to send a signal accordingly to a control/booster (not shown) which is programmed, when the signal from the sensor indicates the presence of flammable vapour above a predetermined threshold, to actuate a servo (not shown) to close the valve 22 and to feed a "Halon" inert gas or carbon dioxide gas from a reservoir 28 into the engine inlet manifold and thence into the engine. This will stop the engine.

A canopy 30 is fitted over the exhaust manifold 12 and the turbo-charger unit 14. The canopy 30 is of stainless steel and has inwardly extending flanges 32 at each end. Cylinders 33 and 34 containing a "Halon" inert gas are mounted on the canopy 30, each cylinder having an outlet valve 38 at its head connected through pipes to the space 36 between the canopy 30 and the engine 10. Each valve 38 is connected to the control/booster, which is programmed to close the valve 22, to cause injection of the "Halon" or carbon dioxide gas into the inlet manifold and to open the valves 38 and inject "Halon" gas into the space 36, all substantially simultaneously.

Thus, in operation, when the sensor 24 detects above the threshold concentration of a flammable gas, simultaneously the flow of air to the engine 10 is shut off by the valve 22, "Halon" or carbon dioxide gas is injected into the engine 10 from the source 28, and the "Halon" inert gas is injected into the space 36. All three events will bring about cooling of the hot surfaces under the canopy 30 and the last-mentioned event will render the atmosphere in the space 36 inert to safeguard against ignition of the flammable gas.

Figure 3:
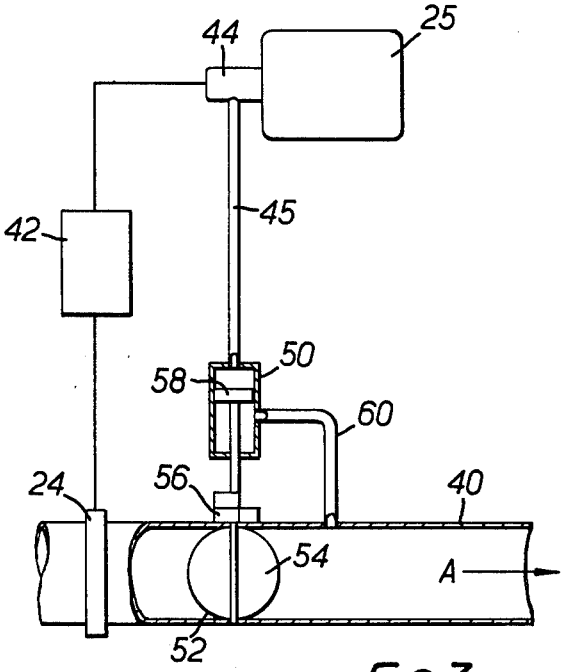
FIG. 3 is diagrammatic view of part of a further internal combustion engine assembly embodying the invention.

In the embodiment shown in FIG. 3 the sensor 24 is disposed, as before, at the mouth of the inlet manifold 40 of an internal combustion engine (not shown). The sensor 24, when it detects the presence of flammable vapour in the air sends a signal to electronic control means 42. If the signal indicates above a critical level of flammable gas in the air the control means fires a "Metron" actuator 44 disposed at the head of a cylinder 25 containing "Halon" inert gas under pressure. "Metron" actuators are available from the Nobel division of Imperial Chemical Industries. Firing the actuator 44 will rupture a seal (not shown) in the head of the cylinder 25 and allow "Halon" gas to escape along a conduit 45 to a pneumatic cylinder 50 fitted to an induction air shut-down valve 52 in the induction manifold 40. The valve 52 comprises a butterfly 54 capable of closing off the manifold, the valve being spring loaded towards the closed position but normally held open against the spring by a cam and latch mechanism 56. The gas pressure in conduit 45 will cause a piston 58 of the pneumatic cylinder 50 to extend a piston rod, trip the cam and latch mechanism 56 and allow the spring to close the butterfly 54. The movement of the piston 58 will open a port in the cylinder wall to a conduit 60 and thus allow "Halon" to enter the manifold 40 downstream of the closed butterfly 54.

A further "Metron" capped "Halon" cylinder arrangement (not shown) may also be connected to the sensor control means 42 so that "Halon" can be injected under the canopy (not shown).

Figure 4:
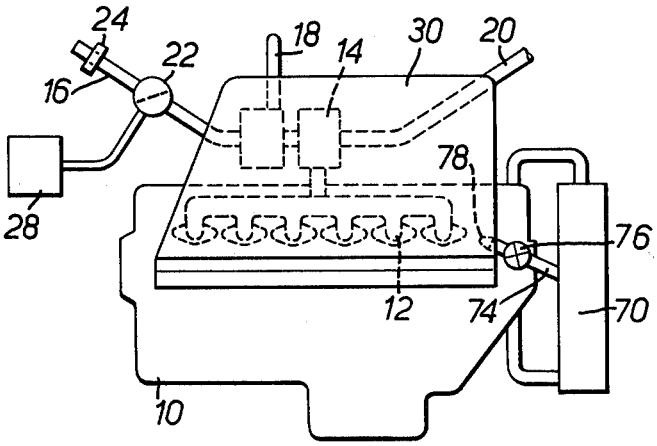
FIG. 4 is a view corresponding to that of FIG. 1 of a still further internal combustion engine assembly embodying the invention.

In the embodiment shown in FIG. 4 the reference numbers 10 to 30 identify the same elements as do those numbers in FIGS. 1 and 2. In this embodiment there is shown a radiator 70 connected to a conduit 74 through a valve and pump arrangement 76 to an injection nozzle 78 within the canopy 30.

When the sensor 24 detects above the threshold concentration of a flammable gas, in addition to operation of valve 22 and injection of "Halon" into the engine the valve and pump arrangement 76 will be actuated to cause water from the coolant system to be injected or squirted into the space 36 through the nozzle 78 onto the hot surface of the engine.

What we claim as our invention and desire to secure by Letters Patent is:

1. An internal combustion engine assembly comprising an engine having an engine air inlet and having a hot external surface exposed to a normally combustion-supporting environment, a sensor for detecting the presence of flammable gases externally of the engine in the vicinity of the assembly, a canopy shrouding said hot surface of the engine, and a source of non-flammable fluid operable responsive to signals from the sensor from detection of the presence of flammable gases externally of the engine in the vicinity of said assembly to inject a sufficient quantity of said non-flammable fluid into the space between the canopy and the said external surface for preventing said flammable gases from burning due to contact with said external surface, by both cooling said surface and by substantially diminishing the combustion-supporting character of said normally combustion-supporting environment.

2. An engine assembly as claimed in claim 1, having an induction air shut-off valve and inert gas injection means to inject inert gas into the engine downstream of the said valve, the said valve and the said gas injection means being responsive to the sensor.

3. An engine assembly as claimed in claim 2, wherein the canopy is fitted over at least one of the engine exhaust manifold and a turbocharger unit.

4. An engine assembly as claimed in claim 1, wherein the canopy is fitted over at least one of the engine exhaust manifold and a turbocharger unit.

5. An engine assembly as claimed in claim 1, wherein the sensor is disposed at the engine air inlet.

6. An engine assembly as claimed in claim 5, wherein the canopy is fitted over at least one of the engine exhaust manifold and a turbocharger unit.

7. An engine assembly as claimed in claim 5, having an induction air shut-off valve and further having another inert gas injection means to inject inert gas into the engine downstream of the said valve, the said valve and the said gas injection means being responsive to the sensor.

8. An engine assembly as claimed in claim 7, wherein the canopy is fitted over at least one of the engine exhaust manifold and a turbocharger unit.

9. An engine assembly as claimed in claim 7, further including means for operating the induction air shut-off valve pneumatically by gas from the said inert gas injection means when said sensor provides said signals.

10. A flameproofing shroud attachment for a hot external surface of an internal combustion engine comprising a canopy for the said hot external surface; a sensor for detecting the presence of flamable gas within said canopy; and means to supply and inject non-flamable fluid into the atmosphere within the canopy responsive to signals from said sensor that flamable gas has been detected within said canopy;

11. An attachment as claimed in claim 10 wherein said means to supply and inject said fluid includes means for injecting said fluid within said canopy at a plurality of fluid injection points, the position of the fluid injection points and the shape of the canopy being such that said fluid, when injected at said points, flows in vortices within said canopy exteriorly of said engine so as to contact said hot external surface.

12. An attachment as claimed in claim 10, wherein the means to supply and inject fluid comprises a pressurized container of inert gas mounted on the canopy.

13. An attachment as claimed in claim 11, wherein the means to supply and inject fluid comprises a pressurized container of inert gas mounted on the canopy.

14. A method of flameproofing an internal combustion engine having a hot external surface comprising detecting the presence in the vicinity of the engine of flammable gases, and in the event of such detection, automatically actuating fluid injection means to inject non-flammable fluid into a space defined between the said external surface and a canopy disposed thereover.

15. A method as claimed in claim 14 wherein the fluid is an inert gas.

16. A method as claimed in claim 14 wherein the fluid is water.

17. A method as claimed in claim 17 wherein the engine includes a coolant system containing water and wherein said water which constitutes said non-flamable fluid is extracted from the engine coolant system for injection into said canopy.

18. A method as claimed in claim 14, wherein in the event of such detection an air shut-off valve is automatically operated and an inert gas is automatically injected into the engine downstream of the air shut-off valve.

19. A method as claimed in claim 15, wherein in the event of such detection an air shut-off valve is automatically operated and an inert gas is automatically injected into the engine downstream of the air shut-off valve.

* * * * *